United States Patent [19]

Di Giovanna

[11] 4,308,157

[45] Dec. 29, 1981

[54] SOAP SAVER

[76] Inventor: Maria Di Giovanna, 61 E. 86th St., Apt. 45, New York, N.Y. 10028

[21] Appl. No.: 185,500

[22] Filed: Sep. 9, 1980

Related U.S. Application Data

[63] Continuation of Ser. No. 40,719, May 21, 1979, abandoned.

[51] Int. Cl.[3] ..... C11D 13/16; C11D 17/02; C11D 17/04

[52] U.S. Cl. ..... 252/92; 252/93; 252/134; 252/174; 252/DIG. 16

[58] Field of Search ..... 252/92, 134, 93, 174, 252/DIG. 16

[56] References Cited

U.S. PATENT DOCUMENTS

| | | | |
|---|---|---|---|
| 624,809 | 5/1899 | Howe | 252/92 |
| 648,247 | 4/1900 | Dunne | 252/92 |
| 1,997,474 | 4/1935 | Stone | 252/92 |
| 3,403,106 | 9/1968 | Story | 252/92 |
| 3,773,672 | 11/1973 | Bredice | 252/92 |

FOREIGN PATENT DOCUMENTS

| | | | |
|---|---|---|---|
| 23561 | of 1903 | United Kingdom | 252/92 |
| 881767 | 11/1961 | United Kingdom | 252/92 |

*Primary Examiner*—Dennis L. Albrecht
*Attorney, Agent, or Firm*—Richard L. Miller

[57] ABSTRACT

A bar of soap having a stiffening core within the center thereof so as to prevent breaking up of the bar when worn down; the core comprising preferably an enclosure containing some useful article, and during the manufacture of the soap bar, the core is suspended inside the empty soap mold by being held between ends of pins passed through the core while liquid soap is poured into the mold around it.

1 Claim, 6 Drawing Figures

SOAP SAVER

This is a continuation, of application Ser. No. 040,719, filed May 21, 1979, now abandoned.

BACKGROUND OF THE INVENTION

This invention relates generally to soap bars and methods of manufacture thereof.

It is well known that when a conventional bar of soap becomes worn down, so that it is thin, it very easily breaks up finally in the hand while a person is lathering up. This is always an annoying situation because lathering up thereafter from small soap pieces is more time consuming and not as efficient. Most persons, being economical, instead of throwing away the broken up soap pieces, still keep them on the soap dish for further use, where they appear unsightly, in addition to no longer being as practical. This situation is objectionable and is, therefore, in want of an improvement.

SUMMARY OF THE INVENTION

Therefore, it is the principal object of the present invention to provide an improved bar of soap that does not break up into pieces after becoming worn down.

Another object is to provide a method for manufacturing such improved bar of soap.

Still another object is to provide an improved bar of soap which, accordingly, includes a strengthening core within the center thereof, and wherein the core additionally comprises some useful article, so that its presence inside the soap bar is not undesirable and which can be used after the soap bar is completely worn away.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

In the drawings:

FIG. 2 is a cross-sectional view of one design of the core comprised of two halves that snap-fit together, and which contain some object of value such as a penny, a coupon or the like.

FIG. 3 illustrates another design of core that contains a liquid such as perfume or the like.

DETAILED DESCRIPTION OF PREFERRED EMBODIMENT

Figure 1:
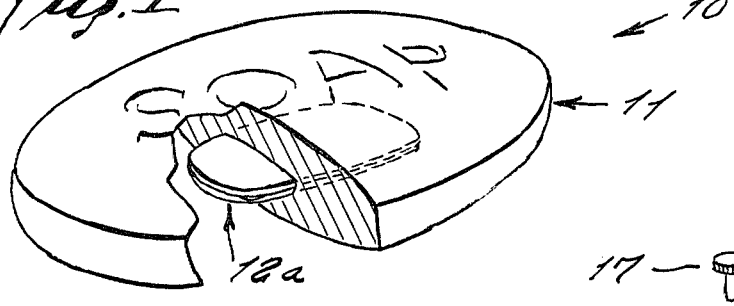
FIG. 1 is a perspective view of a bar of soap, shown partly in cross-section, so as to illustrate the throw away core contained therewithin, shaped like a sliver of worn down soap.
Figure 6:
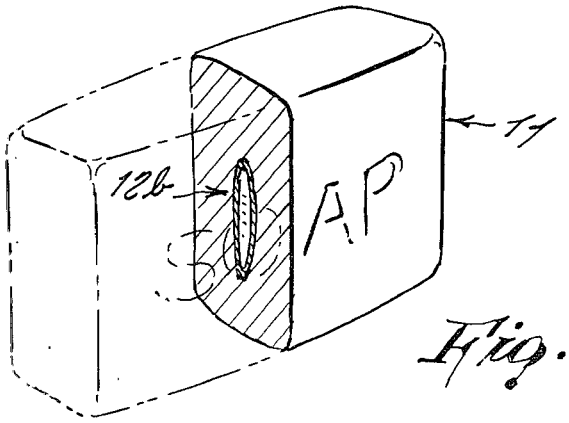
FIG. 6 is a cross-sectional view of the soap bar made in the mold of FIG. 4.

Referring now to the drawing in greater detail, the reference numeral 10 represents a soap saver according to the present invention, wherein the same incorporates a bar of soap 11 having a core molded within the center thereof. The soap bar may be made in any shape, such as oval, rectangular or the like as suggested in FIGS. 1 and 6.

Figure 2:
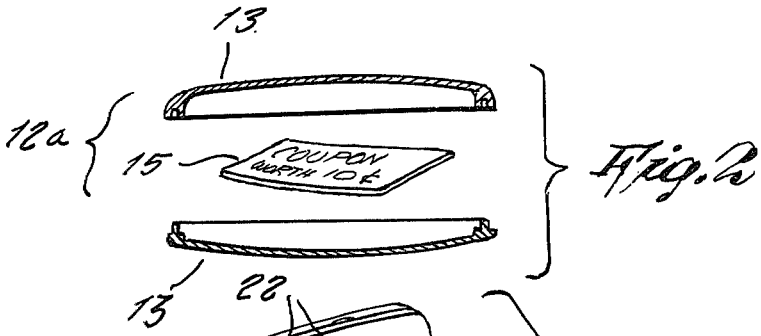
Figure 3:
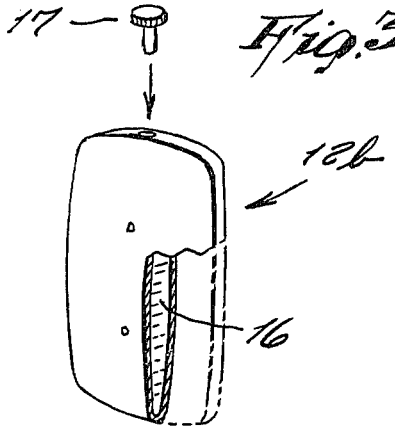
Figure 4:
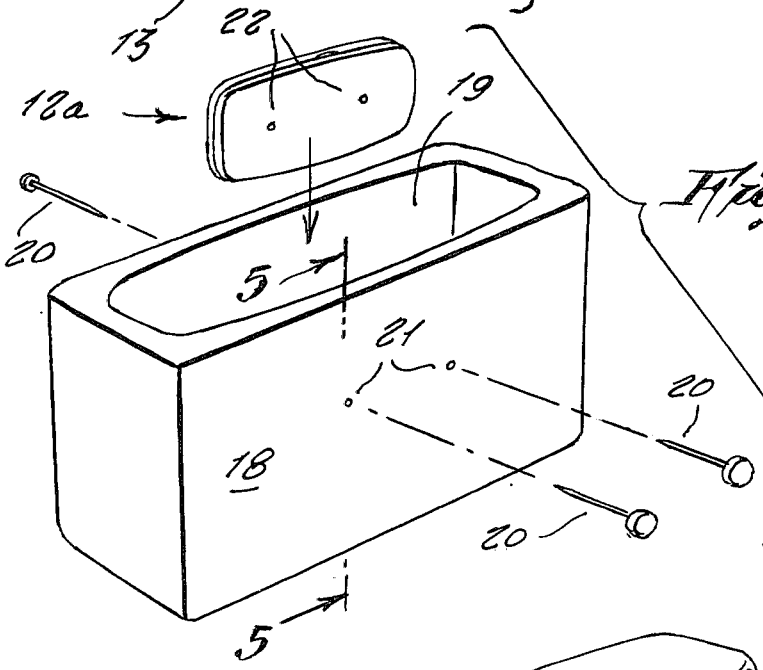
FIG. 4 illustrates a mold in which the soap bar is molded.
Figure 5:
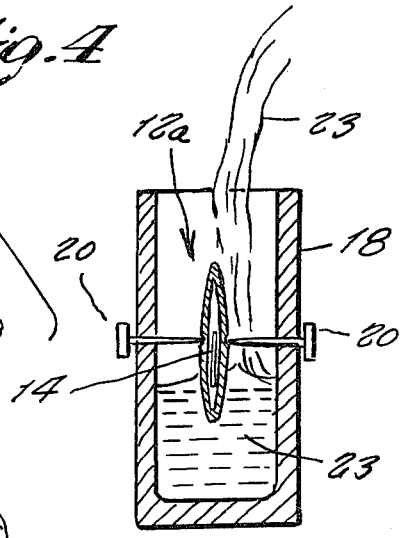
FIG. 5 is a cross-sectional view on line 5—5 of FIG. 4 showing the core supported in the mold during a soap pouring operation.

The core comprises a stiff member made preferably of a hard plastic, so as to be inexpensive. Its outer surface may be roughened so that when the soap bar is worn down, it will not flake off the core. The core preferably comprises a case 12*a*, as suggested in FIGS. 1 and 2 or it may comprise a bottle 12*b*, as shown in FIG. 3. The case has the same thin shape as a worn down soap bar, so that soap wears out equally around it to its surface.

As a case, it is comprised of two halves 13 that interfit together, and which can be opened up. It may contain any possible item that is valuable to the soap user, making it worthwhile to retrieve the item. It may comprise a coin 14 such as a penny or nickel; it may be a money-saving coupon 15 for the next purchase of soap; or it may comprise an item to save such as a unique postage stamp for starting a postage stamp collection, or any other item of interest.

As a bottle, it may contain an interesting perfume 16. A removable small cap 17 screwed on the bottle closes an opening used for access to the perfume.

In the manufacture of the bar of soap 11, a mold 18 is used, having a cavity 19. The core 12 is supported stationarily in the center of the cavity by means of thin pins 20 being inserted into pin holes 21 on opposite sides of the mold, the pointed ends of the pins being fitted into depressions 22 molded on opposite sides of the core. After the core is thus suspended, the soap mixture liquid 23 is poured into the cavity so as to enclose the core within the center thereof.

It should be additionally understood that if desired, the core can be of such a design that the soap has a hollow opening on either or both ends, for easy clean storage on a stick.

After the soap mixture liquid becomes set, the pins are pulled out and the hardened soap bar is then dropped out of the mold; the core being properly located therewithin.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A soap bar in combination with a mold for forming the soap bar, said bar of soap having a hollow opening at one end thereof for storage on a stick, and a stiff core within the center of said bar, said core comprising an enclosure for an item of value that becomes accessible after said bar of soap has been worn away from use, said enclosure having a first outer side and a second outer side, each of said first and second outer sides having a rough surface to aid in retention of said bar of soap on said core, said enclosure further having a plurality of bores formed therethrough from said first outer surface to said second outer surface; said mold for forming said bar of soap comprising a cavity for reception therein of said core and soap, said mold having a first side wall and a second side wall, each of said first and second side walls having a plurality of holes formed therethrough midway thereof in alignment with said plurality of bores of said enclosure; said mold further having a plurality of pins inserted through said plurality of holes of said mold and through said plurality of bores of said enclosure, whereby said enclosure is held suspended in said cavity.

* * * * *